US009468836B2

(12) United States Patent
Huang

(10) Patent No.: US 9,468,836 B2
(45) Date of Patent: Oct. 18, 2016

(54) BOXING DEVICE

(71) Applicant: Ming-Hsiung Huang, Taichung (TW)

(72) Inventor: Ming-Hsiung Huang, Taichung (TW)

( * ) Notice: Subject to any disclaimer, the term of this patent is extended or adjusted under 35 U.S.C. 154(b) by 183 days.

(21) Appl. No.: 14/548,236

(22) Filed: Nov. 19, 2014

(65) Prior Publication Data

US 2015/0072838 A1 Mar. 12, 2015

(51) Int. Cl.

| | |
|---|---|
| ***A63B 71/14*** | (2006.01) |
| ***A63B 21/02*** | (2006.01) |
| ***A63B 69/34*** | (2006.01) |
| ***A63B 69/20*** | (2006.01) |
| ***A63B 21/04*** | (2006.01) |
| ***A63B 21/055*** | (2006.01) |
| ***A63B 23/12*** | (2006.01) |

(52) U.S. Cl.

CPC ..... *A63B 71/145* (2013.01); *A63B 21/0442* (2013.01); *A63B 21/0555* (2013.01); *A63B 21/0557* (2013.01); *A63B 21/4007* (2015.10); *A63B 21/4025* (2015.10); *A63B 21/4035* (2015.10); *A63B 21/4043* (2015.10); *A63B 23/1281* (2013.01); *A63B 69/20* (2013.01); *A63B 2210/50* (2013.01); *A63B 2244/102* (2013.01)

(58) Field of Classification Search

CPC ..... A63B 21/0552; A63B 21/0557; A63B 21/4025; A63B 21/00185; A63B 21/00043; A63B 21/0428; A63B 21/4035; A63B 71/145

USPC ..... 482/126, 83

See application file for complete search history.

(56) References Cited

U.S. PATENT DOCUMENTS

| | | | | |
|---|---|---|---|---|
| 1,432,013 | A * | 10/1922 | Blake | A63B 21/0004 482/124 |
| 5,993,362 | A * | 11/1999 | Ghobadi | A63B 21/0004 482/121 |
| 7,563,212 | B2 * | 7/2009 | Smith | A63B 21/025 482/124 |
| 7,585,260 | B2 * | 9/2009 | Ma | A63B 21/0552 482/106 |
| 8,430,799 | B2 * | 4/2013 | Tussy | A63B 21/0555 482/124 |
| 2010/0173757 | A1 * | 7/2010 | Ma | A63B 21/0552 482/93 |
| 2010/0257651 | A1 * | 10/2010 | Anderson | A63B 71/145 2/18 |
| 2011/0312477 | A1 * | 12/2011 | Wiseman | A63B 21/0442 482/126 |
| 2013/0217547 | A1 * | 8/2013 | Hinds | A63B 7/00 482/96 |
| 2014/0162856 | A1 * | 6/2014 | Kramer | A63B 21/1469 482/139 |

* cited by examiner

*Primary Examiner* — Joshua Kennedy

(57) ABSTRACT

A boxing device is provided with two glove assemblies each including a through hole at either side; a tube having both ends secured to the through holes respectively; a handle formed on the tube between two sides of the glove assembly; two bushing members each including an annular flange at an end, the bushing members are fastened in both ends of the tube respectively with the flanges exposed; two caps each including an arc and a hollow cylinder fastened in one bushing member; an interconnection including two projections at both ends respectively, and openings through one projection; two cord assemblies each including two ring members at either end, each of the ring members being secured to either the arc or the opening; and two retainers each for holding an end portion of the cord assembly adjacent to the projection in place.

2 Claims, 6 Drawing Sheets

BOXING DEVICE

BACKGROUND OF THE INVENTION

1. Field of the Invention

The invention relates to sports equipment and more particularly to a pair of open type boxing gloves connected together by two cord assemblies and an interconnection interconnecting the cord assemblies.

2. Description of Related Art

One drawback of conventional boxing gloves is that humidity may accumulate therein. A fighter may feel uncomforted in his or her fists when wearing the boxing gloves. This uncomfortable feeling is even strong in the summer time. Further, no damping is provided by conventional boxing gloves. Thus, an individual wears the gloves for hitting practice may feel a degree of monotony.

A conventional boxing glove comprises an inner mitt having a front, a back, and a mouth, the inner mitt further having first means for allowing the hand to breath and for removing perspiration from the palm of the glove, second means for preventing the glove from absorbing perspiration, and third means for encouraging proper first formation; a padded outside covering for covering a finger, thumb and hand areas, the padded outside covering attached to the back of the inner mitt, the padded outside covering having means for retaining a thumb; and a padded cuff attached to the mouth of the inner mitt and the padded outside covering, the cuff configured to receive the wrist of the hand, the cuff having means for firmly engaging the wrist.

Thus, the need for improvement still exists.

SUMMARY OF THE INVENTION

It is therefore one object of the invention to provide a boxing device comprising two glove assemblies each including a through hole at either side; a tube having both ends secured to the through holes respectively; a handle formed on the tube between two sides of the glove assembly; two bushing members each including an annular flange at an end, the bushing members are fastened in both ends of the tube respectively with the flanges exposed; two caps each including an arc and a hollow cylinder fastened in one of the bushing members; an interconnection including two projections at both ends respectively, and a plurality of openings formed through one of the projections; two cord assemblies each including two ring members at either end, each of the ring members being secured to either the arc or one of the openings; and two retainers each for holding an end portion of the cord assembly adjacent to one of the projections in place.

The above and other objects, features and advantages of the invention will become apparent from the following detailed description taken with the accompanying drawings.

DETAILED DESCRIPTION OF THE INVENTION

Figure 1:
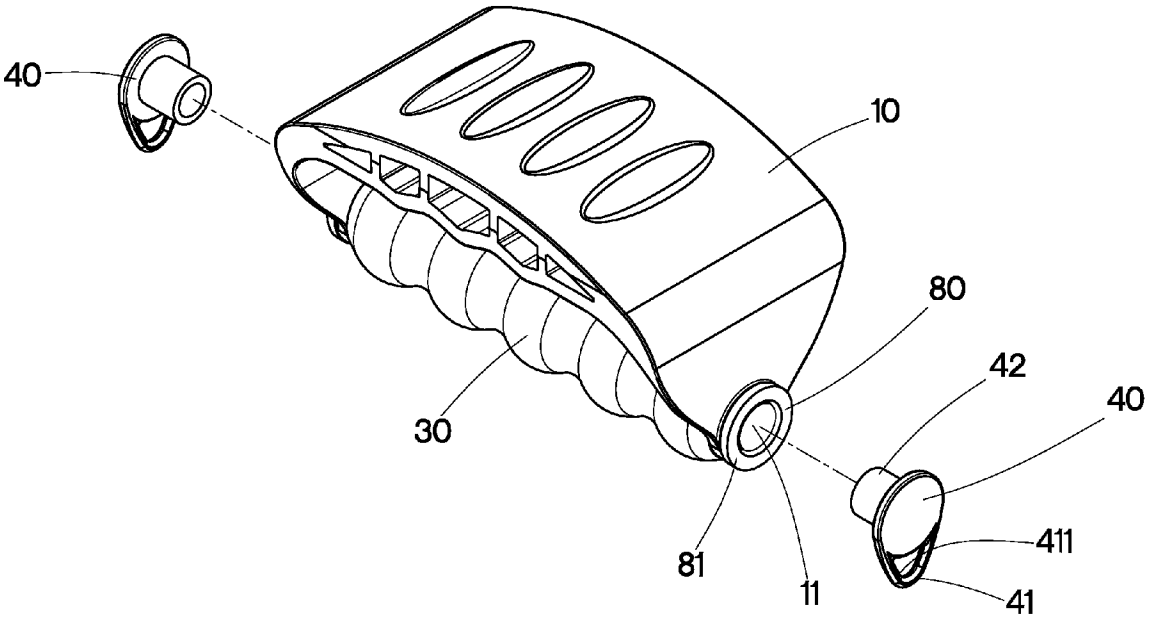
FIG. 1 is an exploded, perspective view of a glove assembly of a boxing device according to the invention.
Figure 2:
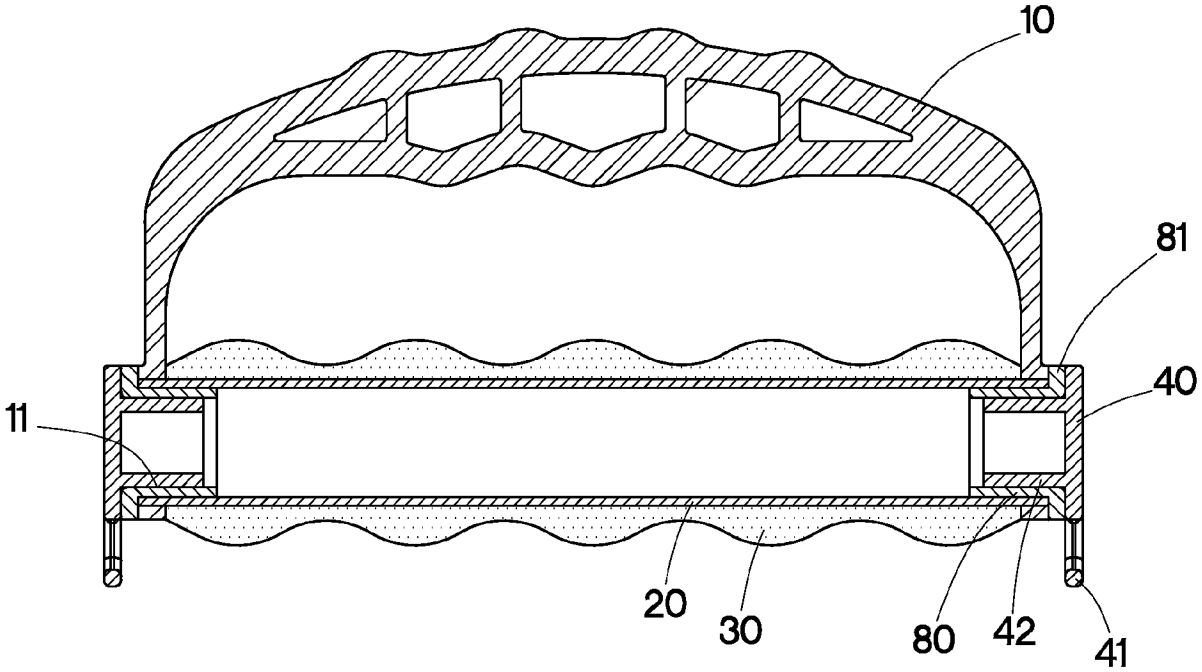
FIG. 2 is a longitudinal sectional view of the assembled glove assembly.
Figure 3:
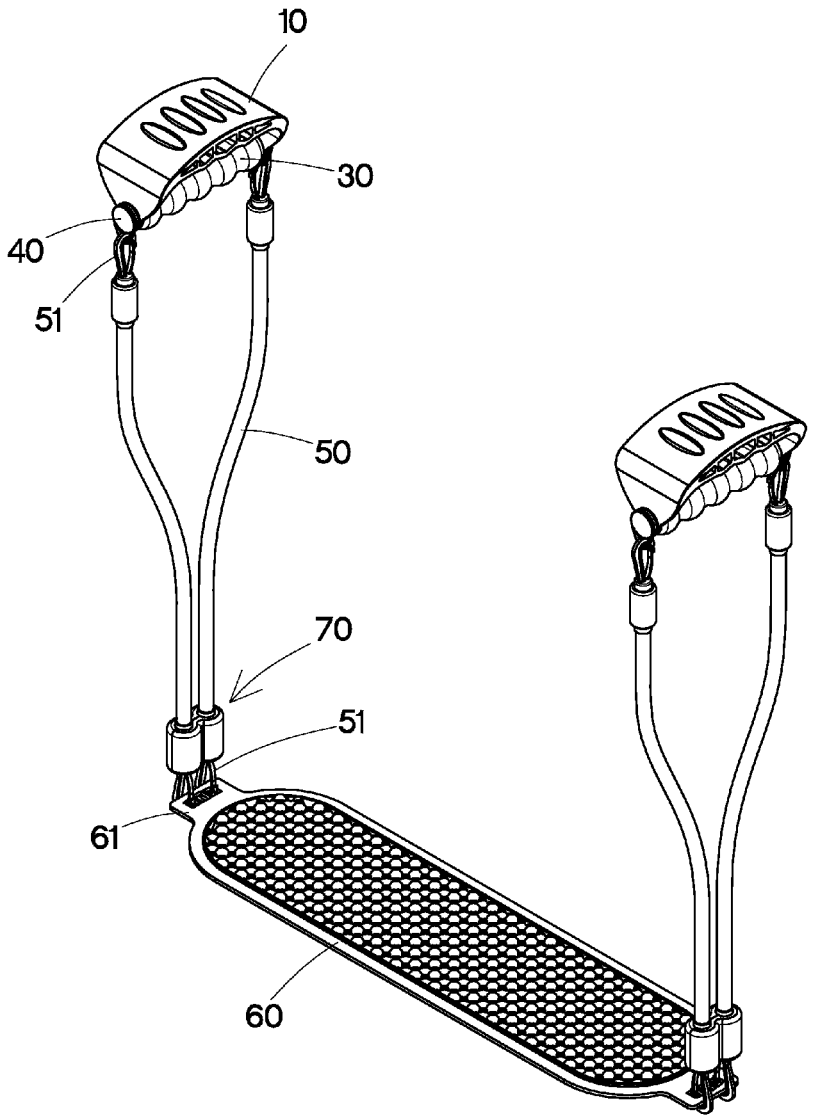
FIG. 3 is a perspective view of the boxing device.
Figure 4:
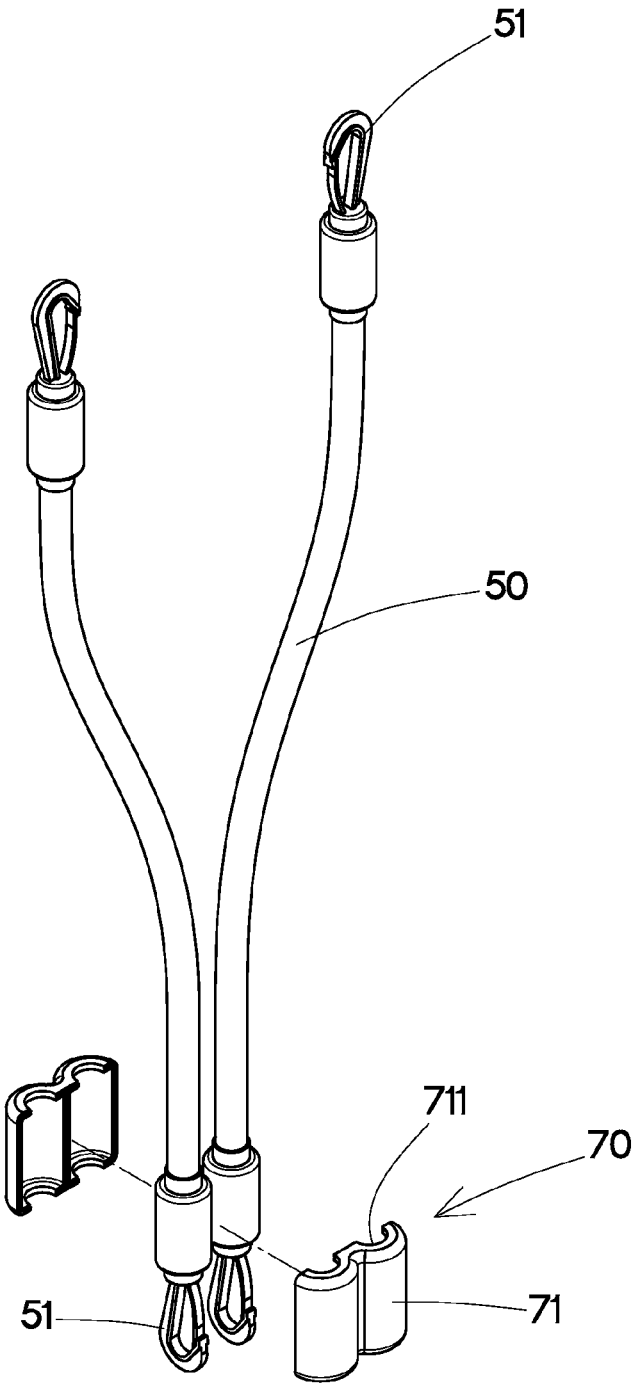
FIG. 4 is an exploded view of the cord assembly.
Figure 5:
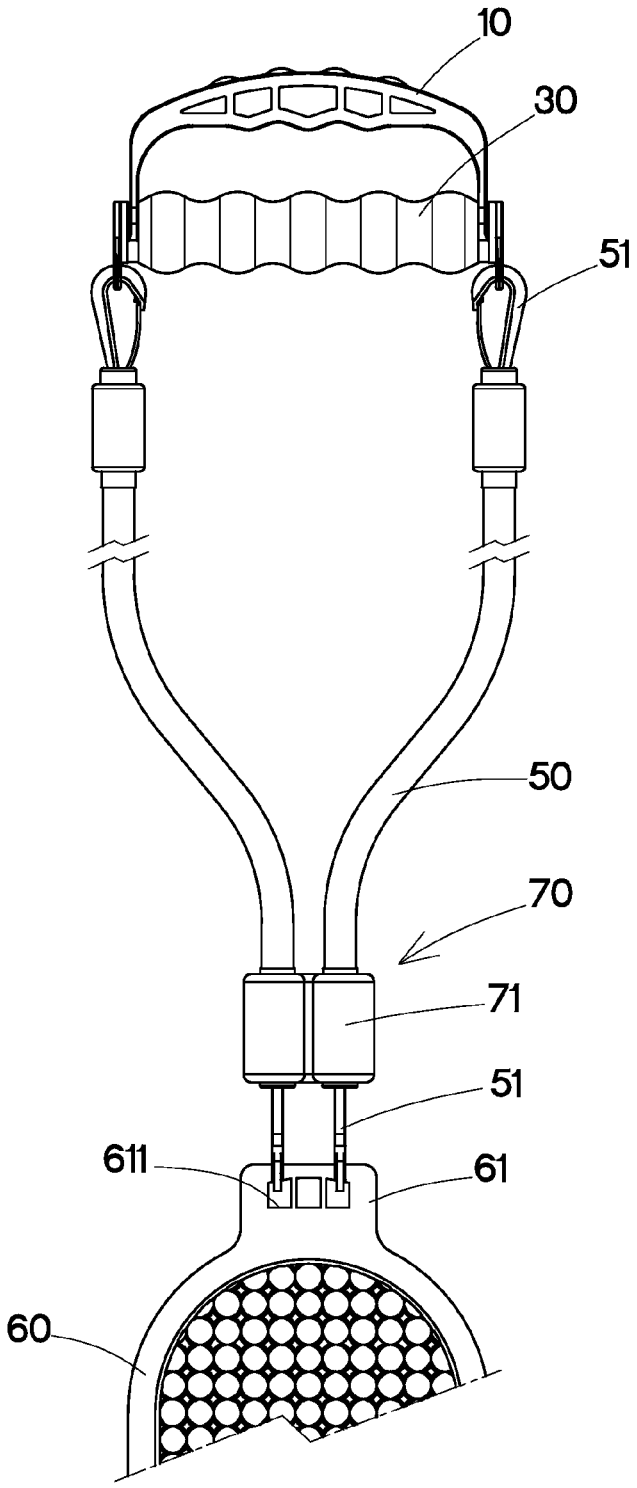
FIG. 5 is a fragmentary view of the boxing device of FIG. 3.

Referring to FIGS. 1 to 6, a boxing device in accordance with the invention comprises the following components as discussed in detail below.

Two glove assemblies 10 are formed of elastomeric material. The glove assembly 10 is bent at two sides. A through hole 11 is formed through either side of the glove assembly 10. A tube 20 has both ends secured to the through holes 11 respectively. A handle 30 formed of elastomeric material is formed around a substantial portion of the tube 20 between two sides of the glove assembly 10. Two tubular bushing members 80 each include an annular flange 81 at one end. The bushing member 80 is frictionally fastened in either end of the tube 20 with the flange 81 exposed. Two caps 40 each include an arc 41 and a hollow cylinder 42 removably, frictionally fitted in the bushing member 80.

An elongated interconnection 60 is provided with two projections 61 at both ends respectively. Three openings 611 are formed through the projection 61. Two cord assemblies 50 formed of flexible, stretchable material are provided. Each cord assembly 50 includes two ring members 51 at either end (i.e., four ring members 51 in total). The ring member 51 is secured to either the arc 41 or the opening 611. Two retainers 70 each include a wavy member 71 having two parallel grooves 711. The four grooves 711 are complimentarily put on an end portion of the cord assembly 50 so as to hold the end portion of the cord assembly 50 in place.

Figure 6:
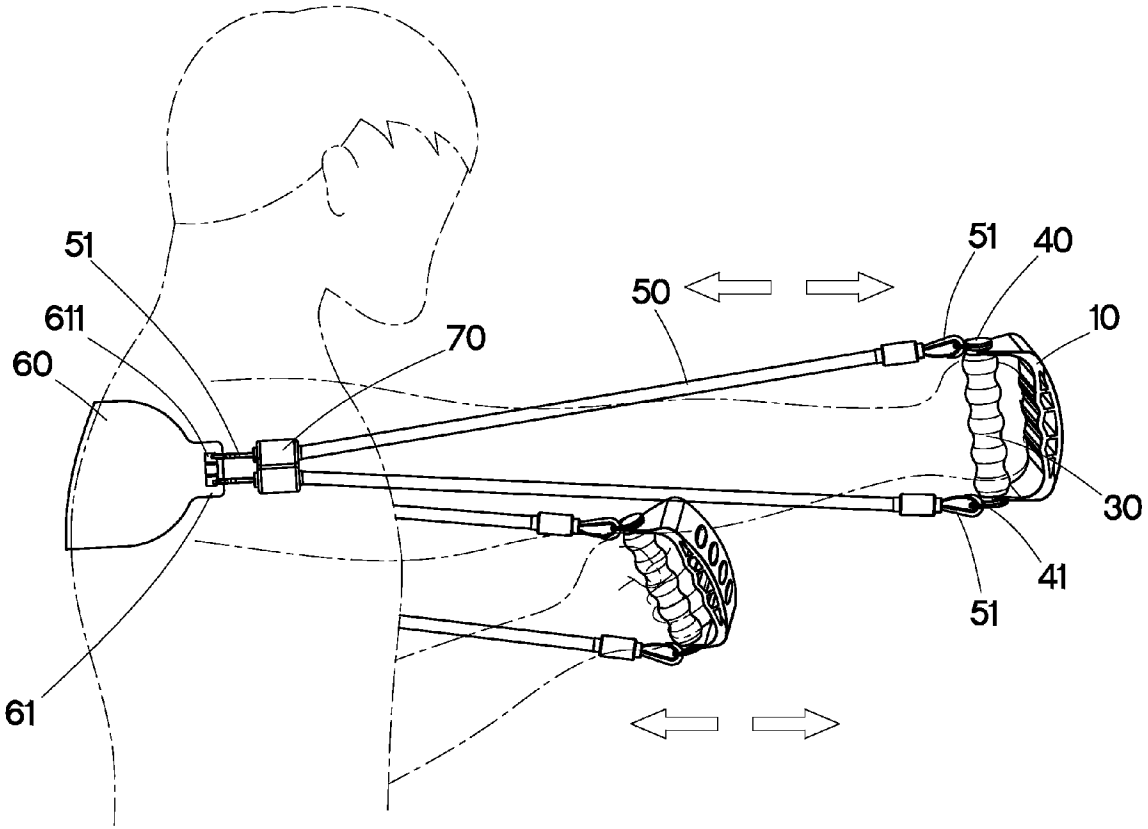
FIG. 6 is an environmental view of an individual using the boxing device for hitting practice.

As shown in FIG. 6, an individual may hold the handles 30 with the interconnection 60 engaging the back. Next, the individual may push one hand forward and pull the other hand rearward in a repeated manner during hitting practice. It is envisaged by the invention that the hands may feel a degree of comfort because the glove assemblies 10 are hollow with a minimum moisture accumulation. Also, the hitting practice is fun due to the damping of the cord assemblies 50.

While the invention has been described in terms of preferred embodiments, those skilled in the art will recognize that the invention can be practiced with modifications within the spirit and scope of the appended claims.

What is claimed is:

1. A boxing device comprising:

two glove assemblies, each comprising:

a glove body having a through hole at each end;

a tube having first and second ends secured to a respective through hole;

a handle formed on the tube between the two ends of the glove body;

two bushing members, each including an annular flange at an end, the bushing members are fastened in the first and second ends of the tube, respectively, with the flanges exposed; and two caps, each including an arc, defining an opening therein, and a hollow cylinder fastened in a respective one of the bushing members;

an interconnection including a projection at first and second ends thereof, and a plurality of openings formed through each of the projections;

two cord assemblies, each comprising:

two ring members at a first end of a respective cord assembly to connect to the openings in the arcs at the first and second ends of a respective glove assembly;

two ring members at a second end of a respective cord assembly to connect to at least one opening of the plurality of openings at a respective end of the interconnection; and a retainer adjacent the second end of a respective cord assembly to hold the respective cord assembly in place.

2. A boxing device comprising:

two glove assemblies, each comprising:

a glove body having a through hole at each end;

a tube having first and second ends secured to a respective through hole;

a handle formed on the tube between the two ends of the glove body;

two caps, each including an arc, defining an opening therein, and a hollow cylinder fastened in a respective end of the tube;

an interconnection including a projection at first and second ends thereof, and a plurality of openings formed through each of the projections;

two cord assemblies, each comprising:

two ring members at a first end of a respective cord assembly to connect to the openings in the arcs at the first and second ends of a respective glove assembly;

two ring members at a second end of a respective cord assembly to connect to at least one opening of the plurality of openings at a respective end of the interconnection; and a retainer adjacent the second end of a respective cord assembly to hold the respective cord assembly in place.

* * * * *